US005946835A

United States Patent [19]

Boyd

[11] Patent Number: 5,946,835

[45] Date of Patent: Sep. 7, 1999

[54] SIMULATED BLOOMING FLOWER

[76] Inventor: Timothy W. Boyd, Rte. 2 Box 145, Cleveland, Va. 24225

[21] Appl. No.: 09/019,025

[22] Filed: Feb. 5, 1998

[51] Int. Cl.[6] ..... G09F 19/08

[52] U.S. Cl. ..... 40/412; 428/24

[58] Field of Search ..... 428/24; 40/412, 40/439; 446/167, 199

[56] References Cited

U.S. PATENT DOCUMENTS

| | | | |
|---|---|---|---|
| 1,148,208 | 7/1915 | Allison . | |
| 1,916,988 | 7/1933 | Pieschke | 40/412 |
| 3,471,964 | 10/1969 | Cherry et al. . | |
| 4,738,881 | 4/1988 | Lee | 428/24 X |
| 4,910,647 | 3/1990 | Gong . | |
| 4,973,891 | 11/1990 | Tzeng | 428/24 X |
| 4,986,531 | 1/1991 | Snaper et al. | 40/407 X |
| 5,090,569 | 2/1992 | Nissen et al. | 206/457 |

*Primary Examiner*—Joanne Silbermann

[57] ABSTRACT

A new simulated blooming flower for simulating the blooming of a flower when water is added. The device includes a container having a sieve therein which defines a reservoir. The sieve has a plurality of drainage apertures. An elongate stem extends from the sieve with the lower end of the stem positioned adjacent the sieve. A rod is disposed in the stem and a float is disposed in the reservoir and coupled to the lower end of the rod. Coupled to the upper end of the stem is a simulated flower having a plurality of simulated petals which are positionable between a closed position and an open blooming position. A plurality of actuating members is provided within the flower with upper ends of the actuating members positioned adjacent to the petals of the flower and lower ends of the actuating members positioned over the stem. A stamen assembly pushes the actuating members when the stamen assembly is upwardly extended such that the petals of the flower member are moved towards the blooming position.

5 Claims, 3 Drawing Sheets

SIMULATED BLOOMING FLOWER

BACKGROUND OF THE INVENTION

1. Field of the Invention

The present invention relates to simulated flowers and more particularly pertains to a new simulated blooming flower for simulating the blooming of a flower when water is added.

2. Description of the Prior Art

The use of simulated flowers is known in the prior art. More specifically, simulated flowers heretofore devised and utilized are known to consist basically of familiar, expected and obvious structural configurations, notwithstanding the myriad of designs encompassed by the crowded prior art which have been developed for the fulfillment of countless objectives and requirements.

Known prior art simulated flowers include U.S. Pat. No. 5,314,730; U.S. Pat. No. 4,943,455; U.S. Pat. No. 4,957,787; U.S. Pat. No. 4,958,768; U.S. Pat. No. 4,515,572; and U.S. Pat. No. Des. 246,232.

While these devices fulfill their respective, particular objectives and requirements, the aforementioned patents do not disclose a new simulated blooming flower. The inventive device includes a container having a side wall and a base wall that define the container's hollow interior. A sieve member is provided within the container hollow interior and is disposed between the top opening of the container and the base wall of the container. The sieve member is spaced apart from the base wall of the container to define a reservoir. The sieve member also has a plurality of drainage apertures. An elongate tubular simulated stem member is upwardly extended from the sieve member with the lower end of the stem member is positioned adjacent the sieve member. A lower opening is extended through the sieve member and the lower end of the stem member and opens into the lumen of the stem member. An elongate rod is disposed in the lumen of the stem member with the lower end of the rod downwardly extended from the stem member into the reservoir. A float member is disposed in the reservoir and is coupled to the lower end of the rod. A simulated flower member is coupled to the upper end of the stem member. The flower member has a plurality of simulated petals which are positionable between a closed position and an open blooming position. An upper opening is extended through the flower member and the upper end of the stem member into the lumen of the stem member. A plurality of actuating members is provided within the flower interior space and arc radially extended outwards from the upper opening. The upper ends of the actuating members are positioned adjacent to the petals of the flower member while the lower ends of the actuating members are positioned over the upper opening. A stamen assembly is disposed in the lumen of the stem member and is positioned towards the upper end of the stem member. The stamen assembly pushes the actuating members when the stamen assembly is upwardly extended through the upper opening such that the petals of the flower member are moved towards the blooming position as the stamen assembly is upwardly extended through the upper opening.

In these respects, the simulated blooming flower according to the present invention substantially departs from the conventional concepts and designs of the prior art, and in so doing provides an apparatus primarily developed for the purpose of simulating the blooming of a flower when water is added.

SUMMARY OF THE INVENTION

In view of the foregoing disadvantages inherent in the known types of simulated flowers now present in the prior art, the present invention provides a new simulated blooming flower construction wherein the same can be utilized for simulating the blooming of a flower when water is added.

The general purpose of the present invention, which will be described subsequently in greater detail, is to provide a new simulated blooming flower apparatus and method which has many of the advantages of the simulated flowers mentioned heretofore and many novel features that result in a new simulated blooming flower which is not anticipated, rendered obvious, suggested, or even implied by any of the prior art simulated flowers, either alone or in any combination thereof.

To attain this, the present invention generally comprises a container having a side wall and a base wall that define the container's hollow interior. A sieve member is provided within the container hollow interior and is disposed between the top opening of the container and the base wall of the container. The sieve member is spaced apart from the base wall of the container to define a reservoir. The sieve member also has a plurality of drainage apertures. An elongate tubular simulated stem member is upwardly extended from the sieve member with the lower end of the stem member is positioned adjacent the sieve member. A lower opening is extended through the sieve member and the lower end of the stem member and opens into the lumen of the stem member. An elongate rod is disposed in the lumen of the stem member with the lower end of the rod downwardly extended from the stem member into the reservoir. A float member is disposed in the reservoir and is coupled to the lower end of the rod. A simulated flower member is coupled to the upper end of the stem member. The flower member has a plurality of simulated petals which are positionable between a closed position and an open blooming position. An upper opening is extended through the flower member and the upper end of the stem member into the lumen of the stem member. A plurality of actuating members is provided within the flower interior space and are radially extended outwards from the upper opening. The upper ends of the actuating members are positioned adjacent to the petals of the flower member while the lower ends of the actuating members are positioned over the upper opening. A stamen assembly is disposed in the lumen of the stem member and is positioned towards the upper end of the stem member. The stamen assembly pushes the actuating members when the stamen assembly is upwardly extended through the upper opening such that the petals of the flower member are moved towards the blooming position as the stamen assembly is upwardly extended through the upper opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new simulated blooming flower apparatus and method which has many of the advantages of the simulated flowers mentioned heretofore and many novel features that result in a new simulated blooming flower which is not anticipated, rendered obvious, suggested, or even implied by any of the prior art simulated flowers, either alone or in any combination thereof.

It is another object of the present invention to provide a new simulated blooming flower which may be easily and efficiently manufactured and marketed.

It is a further object of the present invention to provide a new simulated blooming flower which is of a durable and reliable construction.

An even further object of the present invention is to provide a new simulated blooming flower which is susceptible of a low cost of manufacture with regard to both materials and labor, and which accordingly is then susceptible of low prices of sale to the consuming public, thereby making such simulated blooming flower economically available to the buying public.

Still yet another object of the present invention is to provide a new simulated blooming flower which provides in the apparatuses and methods of the prior art some of the advantages thereof, while simultaneously overcoming some of the disadvantages normally associated therewith.

Still another object of the present invention is to provide a new simulated blooming flower for simulating the blooming of a flower when water is added.

Yet another object of the present invention is to provide a new simulated blooming flower which includes a container having a side wall and a base wall that define the container's hollow interior. A sieve member is provided within the container hollow interior and is disposed between the top opening of the container and the base wall of the container. The sieve member is spaced apart from the base wall of the container to define a reservoir. The sieve member also has a plurality of drainage apertures. An elongate tubular simulated stem member is upwardly extended from the sieve member with the lower end of the stem member is positioned adjacent the sieve member. A lower opening is extended through the sieve member and the lower end of the stem member and opens into the lumen of the stem member. An elongate rod is disposed in the lumen of the stem member with the lower end of the rod downwardly extended from the stem member into the reservoir. A float member is disposed in the reservoir and is coupled to the lower end of the rod. A simulated flower member is coupled to the upper end of the stem member. The flower member has a plurality of simulated petals which are positionable between a closed position and an open blooming position. An upper opening is extended through the flower member and the upper end of the stem member into the lumen of the stem member. A plurality of actuating members is provided within the flower interior space and are radially extended outwards from the upper opening. The upper ends of the actuating members are positioned adjacent to the petals of the flower member while the lower ends of the actuating members are positioned over the upper opening. A stamen assembly is disposed in the lumen of the stem member and is positioned towards the upper end of the stem member. The stamen assembly pushes the actuating members when the stamen assembly is upwardly extended through the upper opening such that the petals of the flower member are moved towards the blooming position as the stamen assembly is upwardly extended through the upper opening.

Still yet another object of the present invention is to provide a new simulated blooming flower that will fascinate people in simulating how a flower blooms.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
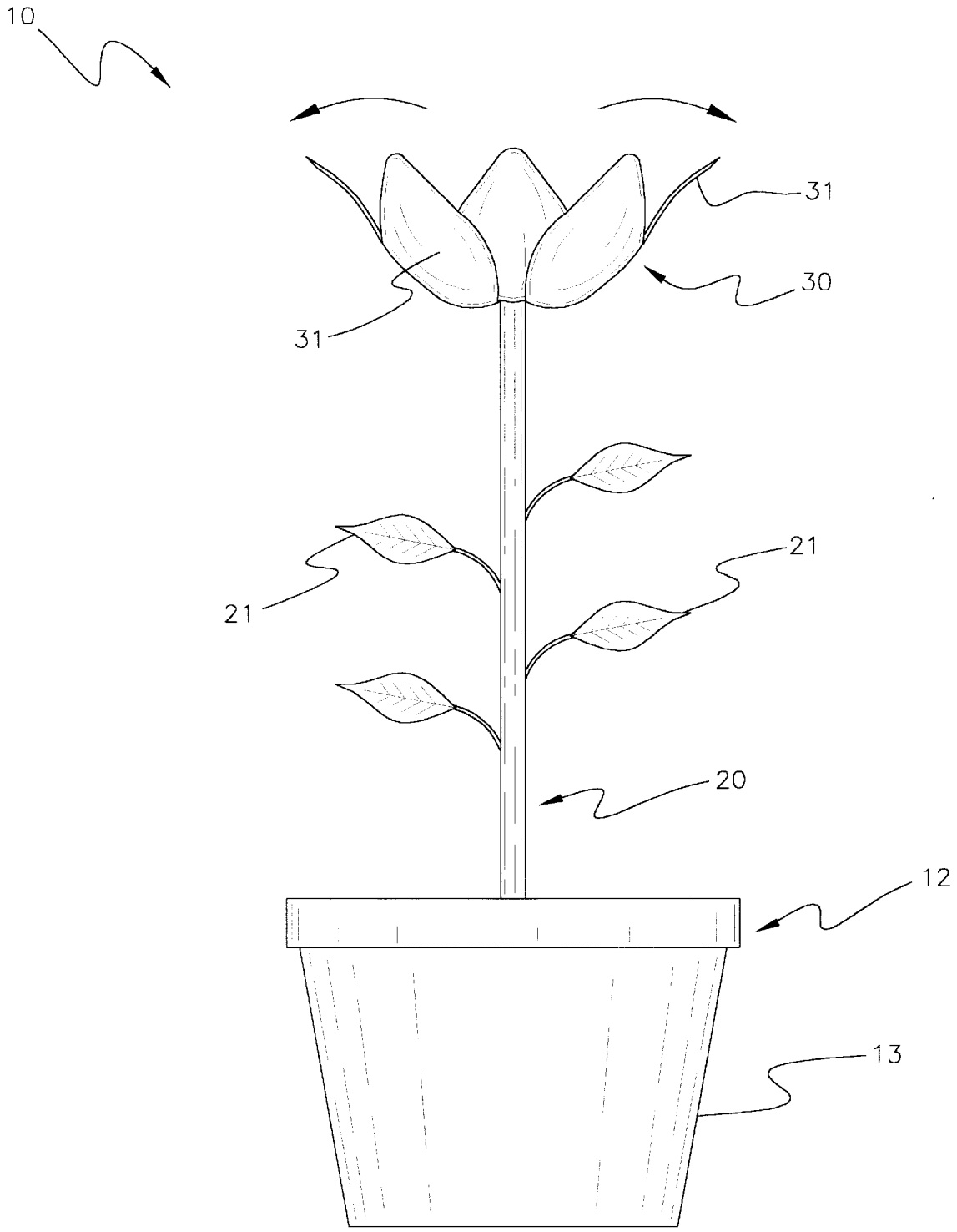
FIG. 1 is a schematic side view of a new simulated blooming flower according to the present invention.
Figure 2:
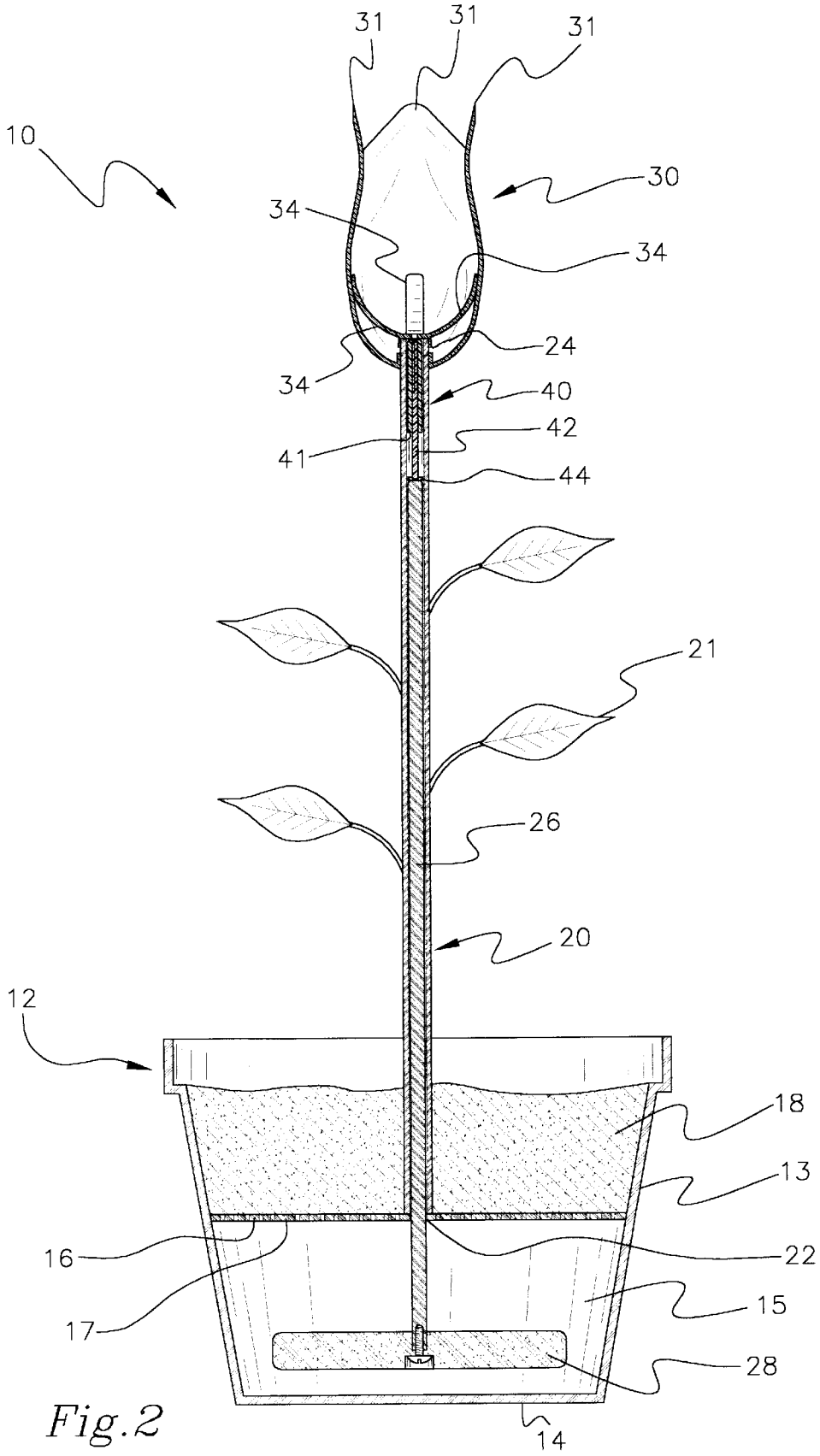
FIG. 2 is a schematic cross-sectional view of the present invention with the flower member in the closed position.
Figure 3:
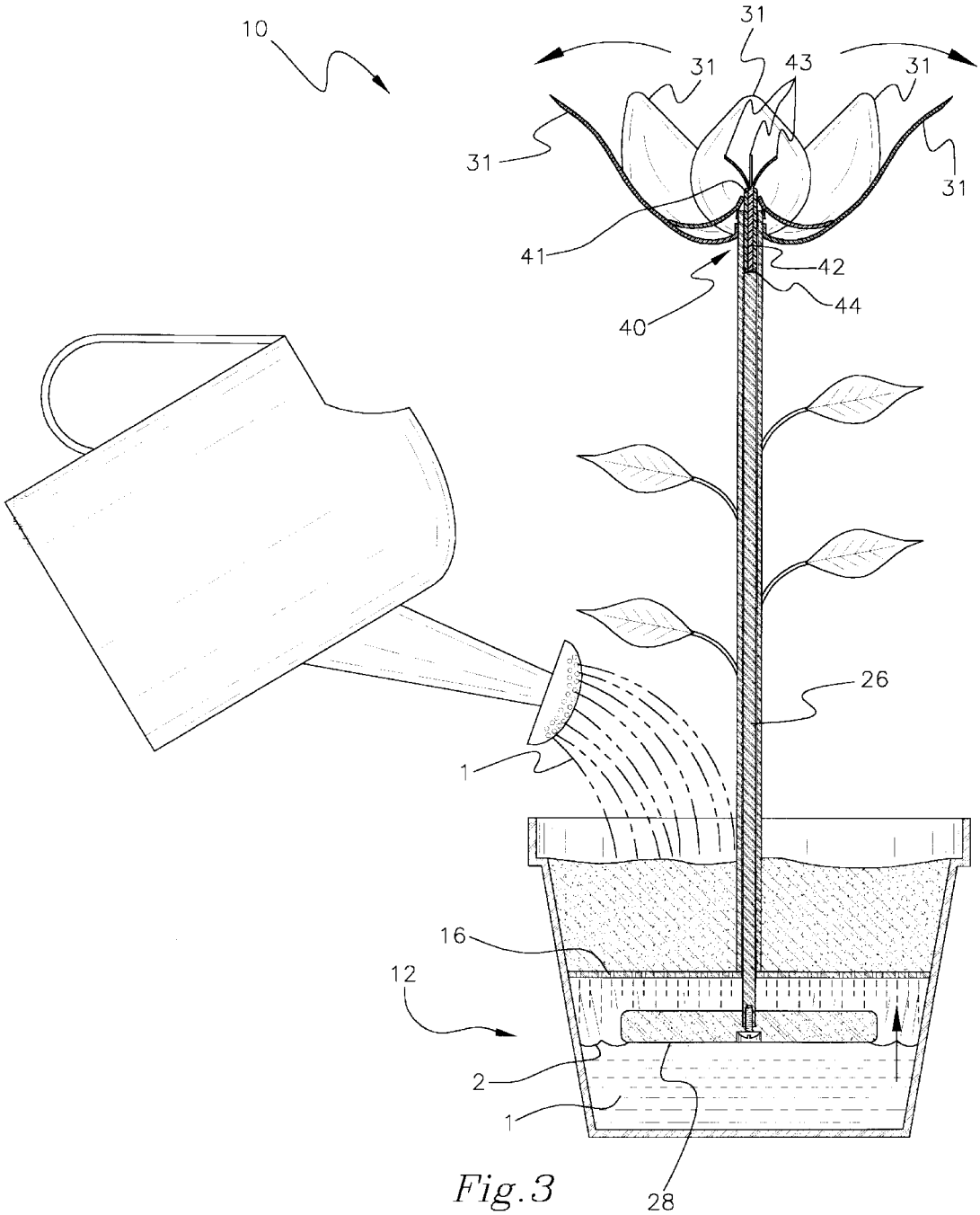
FIG. 3 is a schematic cross-sectional view of the present invention with the flower member being moved towards the blooming position.

With reference now to the drawings, and in particular to FIGS. 1 through 3 thereof, a new simulated blooming flower embodying the principles and concepts of the present invention and generally designated by the reference numeral 10 will be described.

As best illustrated in FIGS. 1 through 3, the simulated blooming flower 10 generally comprises a container 12 having a side wall 13 and a base wall 14 that define the container's hollow interior. A sieve member 16 is provided within the container hollow interior and is disposed between the top opening of the container 12 and the base wall 14 of the container 12. The sieve member 16 is spaced apart from the base wall 14 of the container 12 to define a reservoir 15. The sieve member 16 also has a plurality of drainage apertures 17. An elongate tubular simulated stem member 20 is upwardly extended from the sieve member 16 with the lower end of the stem member 20 is positioned adjacent the sieve member 16. A lower opening 22 is extended through the sieve member 16 and the lower end of the stem member 20 and opens into the lumen of the stem member 20. An elongate rod 26 is disposed in the lumen of the stem member 20 with the lower end of the rod 26 downwardly extended from the stem member 20 into the reservoir 15. A float member 28 is disposed in the reservoir 15 and is coupled to the lower end of the rod 26. A simulated flower member 30 is coupled to the upper end of the stem member 20. The flower member 30 has a plurality of simulated petals 31 which are positionable between a closed position and an open blooming position. An upper opening 24 is extended through the flower member 30 and the upper end of the stem member 20 into the lumen of the stem member 20. A plurality of actuating members 34 is provided within the flower interior space and are radially extended outwards from the upper opening 24. The upper ends of the actuating members 34 are positioned adjacent to the petals 31 of the flower member 30 while the lower ends of the actuating members 34 are positioned over the upper opening 24. A stamen assembly 40 is disposed in the lumen of the stem member 20 and is positioned towards the upper end of the stem member 20. The stamen assembly 40 pushes the actuating members 34 when the stamen assembly 40 is upwardly extended through the upper opening 24 such that the petals 31 of the flower member 30 are moved towards the blooming position as the stamen assembly 40 is upwardly extended through the upper opening 24.

In closer detail, the container 12 is formed to resemble a flower pot and has a side wall 13 and a base wall 14 which define a container hollow interior. The container 12 also has a top opening into the container hollow interior. The sieve member 16 is provided within the container hollow interior and is disposed between the top opening of the container 12 and the base wall 14 of the container 12. The sieve member 16 is also spaced apart from the base wall 14 of the container 12 to define a reservoir 15 for holding a liquid such as water therein. The sieve member 16 has a plurality of drainage apertures 17 through it that permit the passage of liquids through the sieve member. Preferably, a plurality of simulated dirt particles 18 are disposed in the container hollow interior and are rested on the sieve member 16. The dirt particles 18 define a plurality of spaces therebetween to permit passage of a liquid through the plurality of dirt particles 18.

The elongate tubular simulated stem member 20 is upwardly and generally perpendicularly extended from the sieve member 16 through the top opening of the container 12. The stem member 20 is shaped and formed to simulate the stem of a plant. The stem member 20 has a lumen, an exterior, and opposite upper and lower ends. The lower end of the stem member 20 is positioned adjacent the sieve member 16. Preferably, the exterior of the stem member 20 has a plurality of simulated leaves 21 extending from it. The leaves 21 are ideally shaped and formed to resemble the leaves 21 of a plant.

A central lower opening 22 is extended through the sieve member 16 and the lower end of the stern member 20 and opens into the lumen of the stem member 20. An elongate rod 26 having opposite upper and lower ends is disposed in the lumen of the stem member 20. The lower end of the rod 26 is downwardly extended from the stem member 20 into the reservoir 15. Coupled to the lower end of the rod 26 is a float member 28 which is disposed in the reservoir 15.

The simulated flower member 30 is coupled to the upper end of the stem member 20. The flower member 30 is shaped and formed to resemble a flower and has a plurality of simulated petals 31 shaped and formed to resemble the petals 31 of a flower. The petals 31 defining a flower interior space and are positionable between a closed position, as illustrated in FIG. 2, and an open blooming position to resemble a blooming flower, as illustrated in FIG. 3. An upper opening 24 is extended through the flower member 30 and the upper end of the stem member 20 into the lumen of the stem member 20. Provided within the flower interior space are a plurality of arcuate actuating members 34. With reference to FIG. 2, the actuating members 34 are radially extended outwards from the upper opening 24 with the lower ends of the actuating members 34 positioned over the upper opening 24 and the upper ends of the actuating members 34 positioned adjacent to the petals 31 of the flower member 30.

The stamen assembly 40 is disposed in the lumen of the stem member 20 and is positioned towards the upper end of the stem member 20. Preferably, the stamen assembly 40 includes an elongate outer member 41 and an elongate inner member 42. The outer member 41 has an elongate bore extending through it into which the inner member 42 is inserted into. The inner member 42 has a plurality of separable simulated stamen portions 43 located towards its upper end. The stamen portions 43 are shaped and formed to resemble the stamen of a flower. The lower end of inner member 42 is downwardly extended from the bore of the outer member into the lumen of the stem member 20 towards the upper end of the rod 26 and includes a flange 44.

In use, a liquid is poured through the simulated dirt particles 18 and the apertures 17 of the sieve member 16 to fill the reservoir. As illustrated in FIG. 3, the adding of liquid raises the liquid level 2 in the reservoir such that the float member 28 rises accordingly in the reservoir 15. As the float member is raised, the upper end of the rod 26 is moved towards the upper end of the stem member 20 such that the upper end of the rod 26 pushes on the lower end of the inner member 42 of the stamen assembly 40 to move the upper end of the inner member 42 towards the upper opening 24. This causes the stamen portions to be upwardly extended to represent the stamen of a blooming flower. When the inner member 42 is pushed high enough, the flange 44 of the lower end of the inner member 42 abuts the outer member 41 of the stamen assembly 40 and thereby pushes the outer member out through the upper opening. As the outer member is pushed through the upper opening, it moves the actuating members 34 such that the actuating members 34 move the petals 31 of the flower member 30 towards the blooming position to represent a blooming flower.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A simulated blooming flower device, comprising:

a container having a side wall and a base wall, said side wall and base wall defining a container hollow interior;

said container having a top opening into said container hollow interior;

a sieve member being provided within said container hollow interior and being disposed between said top opening of said container and said base wall of said container, said sieve member being spaced apart from said base wall of said container to define a reservoir;

said sieve member having a plurality of drainage apertures therethrough;

an elongate tubular simulated stem member being upwardly extended from said sieve member;

said stem member having a lumen, an exterior, and opposite upper and lower ends, said lower end of said stem member being positioned adjacent said sieve member;

a lower opening being extended through said sieve member and said lower end of said stem member and opening into said lumen of said stem member;

an elongate rod having opposite upper and lower ends, said rod being disposed in said lumen of said stem member, said lower end of said rod being downwardly extended from said stem member into said reservoir;

a float member being disposed in said reservoir and being coupled to said lower end of said rod;

a simulated flower member being coupled to said upper end of said stem member, said flower member having a plurality of simulated petals, said petals defining a flower interior space, said petals being positionable between a closed position and an open blooming position;

an upper opening being extended through said flower member and said upper end of said stem member into said lumen of said stem member;

a plurality of actuating members being provided within said flower interior space, said actuating members being radially extended outwards from said upper opening, each of said actuating members having an upper end and a lower end, said upper ends of said actuating members being positioned adjacent to said petals of said flower member, said lower ends of said actuating members being positioned over said upper opening; and a stamen assembly being disposed in said lumen of said stem member and being positioned towards said upper end of said stem member, said stamen assembly pushing said actuating members when said stamen assembly is upwardly extended through said upper opening such that said petals of said flower member are moved towards said blooming position as said stamen assembly is upwardly extended through said upper opening.

2. The device of claim 1, further comprising a plurality of simulated dirt particles being disposed in said container hollow interior and being rested on said sieve member, said dirt particles defining a plurality of spaces therebetween to permit passage of a liquid through said plurality of dirt particles.

3. The device of claim 1, wherein said exterior of said stem member has a plurality of simulated leaves being extended therefrom.

4. The device of claim 1, wherein said stamen assembly comprises an elongate outer member and an elongate inner member, said outer member having an elongate bore being extended therethrough, said inner member having upper and lower ends, and a plurality of separable simulated stamen portions being located towards said upper end of said inner member, said inner member being inserted into said bore of said outer member, said lower end of inner member being downwardly extended in said lumen of said stem member towards said upper end of said rod, said lower end of said inner member having a flange.

5. A simulated blooming flower device, comprising:

a container having a side wall and a base wall, said side wall and base wall defining a container hollow interior;

said container having a top opening into said container hollow interior;

a sieve member being provided within said container hollow interior and being disposed between said top opening of said container and said base wall of said container, said sieve member being spaced apart from said base wall of said container to define a reservoir;

said sieve member having a plurality of drainage apertures therethrough;

a plurality of simulated dirt particles being disposed in said container hollow interior and being rested on said sieve member, said dirt particles defining a plurality of spaces therebetween to permit passage of a liquid through said plurality of dirt particles;

an elongate tubular simulated stem member being upwardly extended from said sieve member;

said stem member having a lumen, an exterior, and opposite upper and lower ends, said lower end of said stem member being positioned adjacent said sieve member;

a lower opening being extended through said sieve member and said lower end of said stem member and opening into said lumen of said stem member;

said exterior of said stem member having a plurality of simulated leaves being extended therefrom;

an elongate rod having opposite upper and lower ends, said rod being disposed in said lumen of said stem member, said lower end of said rod being downwardly extended from said stem member into said reservoir;

a float member being disposed in said reservoir and being coupled to said lower end of said rod;

a simulated flower member being coupled to said upper end of said stem member, said flower member having a plurality of simulated petals, said petals defining a flower interior space, said petals being positionable between a closed position and an open blooming position;

an upper opening being extended through said flower member and said upper end of said stem member into said lumen of said stem member;

a plurality of actuating members being provided within said flower interior space, said actuating members being radially extended outwards from said upper opening, each of said actuating members having an upper end and a lower end, said upper ends of said actuating members being positioned adjacent to said petals of said flower member, said lower ends of said actuating members being positioned over said upper opening;

a stamen assembly being disposed in said lumen of said stem member and being positioned towards said upper end of said stem member, said stamen assembly comprising an elongate outer member and an elongate inner member, said outer member having an elongate bore being extended therethrough, said inner member having upper and lower ends, and a plurality of simulated stamen portions being located towards said upper end of said inner member, said inner member being inserted into said bore of said outer member, said lower end of inner member being downwardly extended in said lumen of said stem member towards said upper end of said rod, said lower end of said inner member having a flange; and wherein said stamen assembly pushing said actuating members when said stamen assembly is upwardly extended through said upper opening such that said petals of said flower member are moved towards said blooming position as said stamen assembly is upwardly extended through said upper opening.

* * * * *